US010163586B2

(12) United States Patent
Zhu et al.

(10) Patent No.: US 10,163,586 B2
(45) Date of Patent: Dec. 25, 2018

(54) MOMENTARY STRUCTURE FOR MINI TOGGLE SWITCH

(71) Applicant: Honeywell International Inc., Morris Plains, NJ (US)

(72) Inventors: Sean Zhu, Nanjing (CN); Jack Zhu, Nanjing (CN); Wilson Qin, Nanjing (CN); Dongmei Deng, Nanjing (CN); Xusheng Chen, Nanjing (CN)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/343,654

(22) Filed: Nov. 4, 2016

(65) Prior Publication Data

US 2018/0130615 A1 May 10, 2018

(51) Int. Cl.

| | |
|---|---|
| ***H01H 23/00*** | (2006.01) |
| ***H01H 5/14*** | (2006.01) |
| ***H01H 3/46*** | (2006.01) |
| ***H01H 9/04*** | (2006.01) |

(52) U.S. Cl.

CPC ..... *H01H 5/14* (2013.01); *H01H 3/46* (2013.01); *H01H 9/04* (2013.01); *H01H 2223/002* (2013.01)

(58) Field of Classification Search

CPC .. H01H 5/14; H01H 3/46; H01H 9/04; H01H 2223/002; H01H 21/00; H01H 21/02; H01H 21/36; H01H 21/42; H01H 2003/00; H01H 2003/02; H01H 2235/00; H01H 2235/004

USPC ..... 200/5 A, 401, 315

See application file for complete search history.

(56) References Cited

U.S. PATENT DOCUMENTS

| | | | | |
|---|---|---|---|---|
| 2,248,362 A * | 7/1941 | Krieger | ..... | H01H 23/16 200/437 |
| 2,835,754 A | 5/1958 | Lewis | | |
| 3,715,534 A | 2/1973 | Piber | | |
| 4,272,662 A | 6/1981 | Simpson | | |
| 5,045,648 A * | 9/1991 | Fogleman, Sr. | ..... | H01H 3/20 200/325 |

* cited by examiner

*Primary Examiner* — Anthony R. Jimenez
(74) *Attorney, Agent, or Firm* — Craig Thompson; Thompson Patent Law

(57) ABSTRACT

Embodiments relate generally to methods and systems for providing a bias mechanism for a momentary toggle switch. A toggle switch may comprise a housing; a plurality of contacts disposed within the housing; an actuating lever coupled to a pivot pin, wherein the actuating lever extends into the housing; an actuator assembly coupled to the actuating lever, configured to actuate a movable contact of the plurality of contacts between a first position and a second position; and a biasing mechanism configured to bias the actuator assembly into the first position, wherein the biasing mechanism comprises a torque spring.

20 Claims, 5 Drawing Sheets

MOMENTARY STRUCTURE FOR MINI TOGGLE SWITCH

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

A toggle switch is a switch in which a projecting lever can be used to open or to close an electric circuit. Toggle switches of various types have been utilized to control power in domestic, commercial, and industrial applications for operating various electrical devices and equipment.

SUMMARY

In an embodiment, a toggle switch may comprise a housing; a plurality of contacts disposed within the housing; an actuating lever coupled to a pivot pin, wherein the actuating lever extends into the housing; an actuator assembly coupled to the actuating lever, configured to actuate a movable contact of the plurality of contacts between a first position and a second position; and a biasing mechanism configured to bias the actuator assembly into the first position, wherein the biasing mechanism comprises a torque spring.

In an embodiment, a method of operating a toggle switch may comprise providing an actuation force to an actuating lever while the actuating lever is in a first position; moving an actuator assembly located at the end of the actuating lever from the first position toward a second position in response to the actuation force; compressing a torque spring disposed about the actuating lever in response to the moving; and actuating an electrical connection between a movable contact and a fixed contact in response to the moving.

In an embodiment, a toggle switch may comprise a housing; a fixed contact disposed within the housing; a movable contact disposed within the housing, wherein the movable contact is configured to move between a first position and a second position; an actuating lever coupled to a pivot pin, wherein the actuating lever extends into the housing; an actuator assembly coupled to the actuating lever, configured to actuate the movable contact between the first position and the second position; and a biasing mechanism configured to bias the actuator assembly into the first position, wherein the biasing mechanism comprises a torque spring configured to attach to the housing and the actuating lever.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
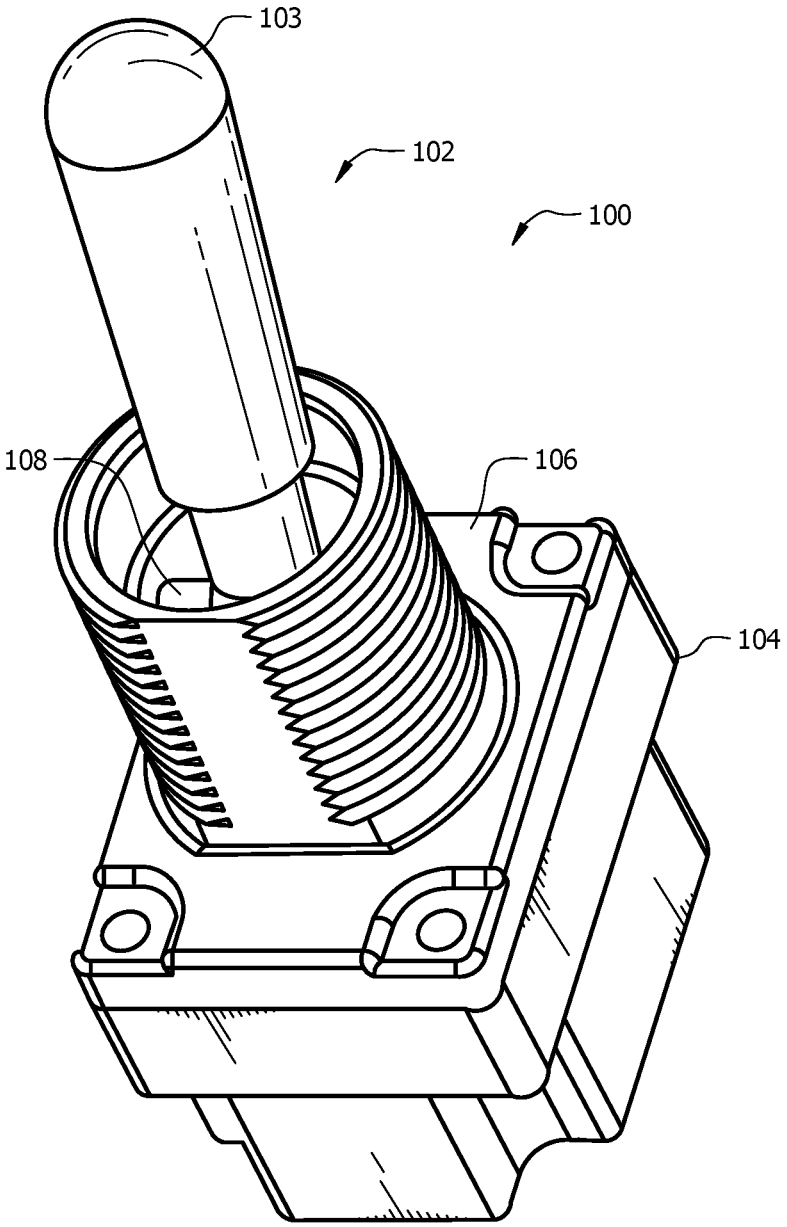
FIG. 1 (Prior Art)
FIG. 1 illustrates a perspective view of a toggle switch.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments of the disclosure include systems and methods for operating a momentary toggle switch. Toggle switches can be manufactured with a housing that contains electrical contacts and is fitted with a manually operable handle to switch power to externally mounted terminals. In an embodiment of a toggle switch, the handle has a biasing mechanism internal to the housing that actuates one or more elements to make or break electrical conductivity with the contacts. Toggle switches may be used in many harsh environments, wherein the switches may be subjected to vibrations, temperature extremes, dust, and/or water. The switches may also be designed to be well suited for operation with gloved hands.

In momentary toggle switches, the switch may be biased toward a first position, unless a force is acting on the switch to push the switch into a second position. Biasing mechanisms are important to the function of the switch, as it is necessary for the switch to return to the first position when the force is no longer applied to the switch. If the biasing mechanism were to fail, the resulting signal could cause failure of the control system. When used in critical operations such as aircraft control, such failure may be catastrophic. Disclosed herein is a toggle switch that addresses the need for a simple bias mechanism with less opportunity for failure, as well as decreased housing dimensions.

Referring now to FIG. 1, a toggle switch 100 is shown assembled, where the toggle switch 100 comprises a toggle mechanism 102 having an actuating lever 103 extending into a housing 104. The actuating lever 103 may extend from an exterior of the housing 104 into an interior of the housing 104 through a cap 106. The cap 106 can be affixed and/or sealed to the housing 104. A pivot pin 108 can be coupled to the cap 106 and extend through the actuating lever 103 to serve as a pivot point for the actuating lever 103 and control the movement of the actuating lever 103 about the axis of the pivot pin 108. In some embodiments, the toggle switch 100 may comprise one or more seals or sealing elements located between the elements of the toggle switch 100.

Figure 2:
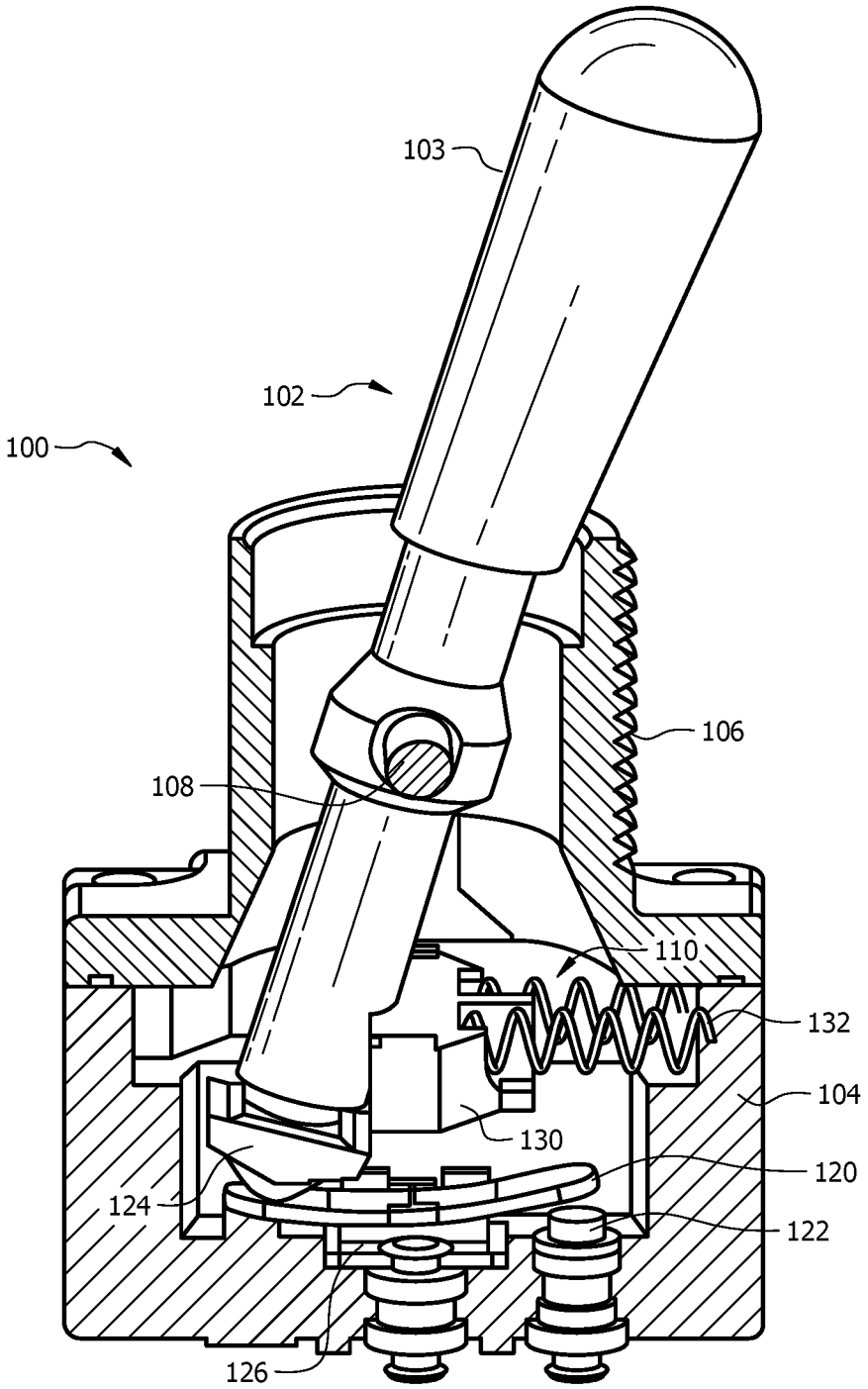
FIG. 2 (Prior Art)
FIG. 2 illustrates a cross-sectional view of a toggle switch.

FIG. 2 illustrates a cross-sectional view of the toggle switch 100. The toggle switch 100 may comprise a momentary toggle switch, wherein the toggle mechanism 102 may be biased in an "open" position unless a force acts on the switch to momentarily move the toggle mechanism 102 to a "closed" position, activating an electrical current. When no force is active on the actuating lever 103 outside of the cap 106, another force within the housing 104 may bias the actuating lever 103 into an open position. This force may be provided by a biasing mechanism 110.

An actuator assembly 124 can be coupled to an end of the actuating lever 103 within the housing 104 to allow actuation of a movable contact 120. One or more electrical connections 122 and 126 (which may be contacts, retainers, or other conductive elements) can be placed in electrical contact through the movable contact 120 to provide signals to external devices, such as controllers. In some embodiments, the movable contact 120 may comprise a curved element attached to a conductive retainer 126 which may serve as an axis for the movable contact 120, wherein the actuator assembly 124 may move along the movable contact 120 and rotate the movable contact 120 about the axis 126. The moveable contact 120 can be coupled to the first contact through a conductive retainer 126, thereby electrically coupling the moveable contact 120 to the first contact. When pivoted into contact with the second contact, an electrical connection can be formed between the first and second contacts through the conductive retainer 126 and the moveable contact 120.

In FIG. 2, the toggle switch may be in an "open" position when the movable contact 120 is not in contact with the fixed contact 122, and therefore there is no electrical current through the movable contact 120 and fixed contact 122. When an external force is applied to the actuating lever 103, the actuator assembly 124 may move the movable contact 120 into contact with the fixed contact 122, thereby creating an electrical connection between the two contacts.

As shown in FIG. 2, the actuating lever 103 can extend from an exterior of the housing 104 into an interior of the housing 104 through a cap 106. A pivot pin 108 can be coupled to the cap 106 and extend through the actuating lever 103 to serve as a pivot point for the actuating lever 103 and control the movement of the actuating lever 103 about the axis of the pivot pin 108. For example, the actuating lever 103 can be constrained to move in a direction normal to the longitudinal axis of the pivot pin 108 in a rotational manner.

The biasing mechanism 110 may comprise one or more springs 132 configured to bias the actuator assembly 124 away from the fixed contact 122 and into the open position. The springs 132 may compress when the actuator assembly 124 is pushed toward the fixed contact 122 by a force on the actuating lever 103. The biasing mechanism 110 may also comprise a push plate 130 attached to the springs 132 and configured to push against the lower end of the actuating lever 103 near the actuator assembly 124. The push plate 130 may be shaped to fit around/against at least a portion of the actuating lever 103 while also serving to retain the springs 132 in position. In the toggle switch 100 shown in FIG. 2, the biasing mechanism 110 includes three separate elements: the two springs 132 and the push plate 130.

Figure 3A:
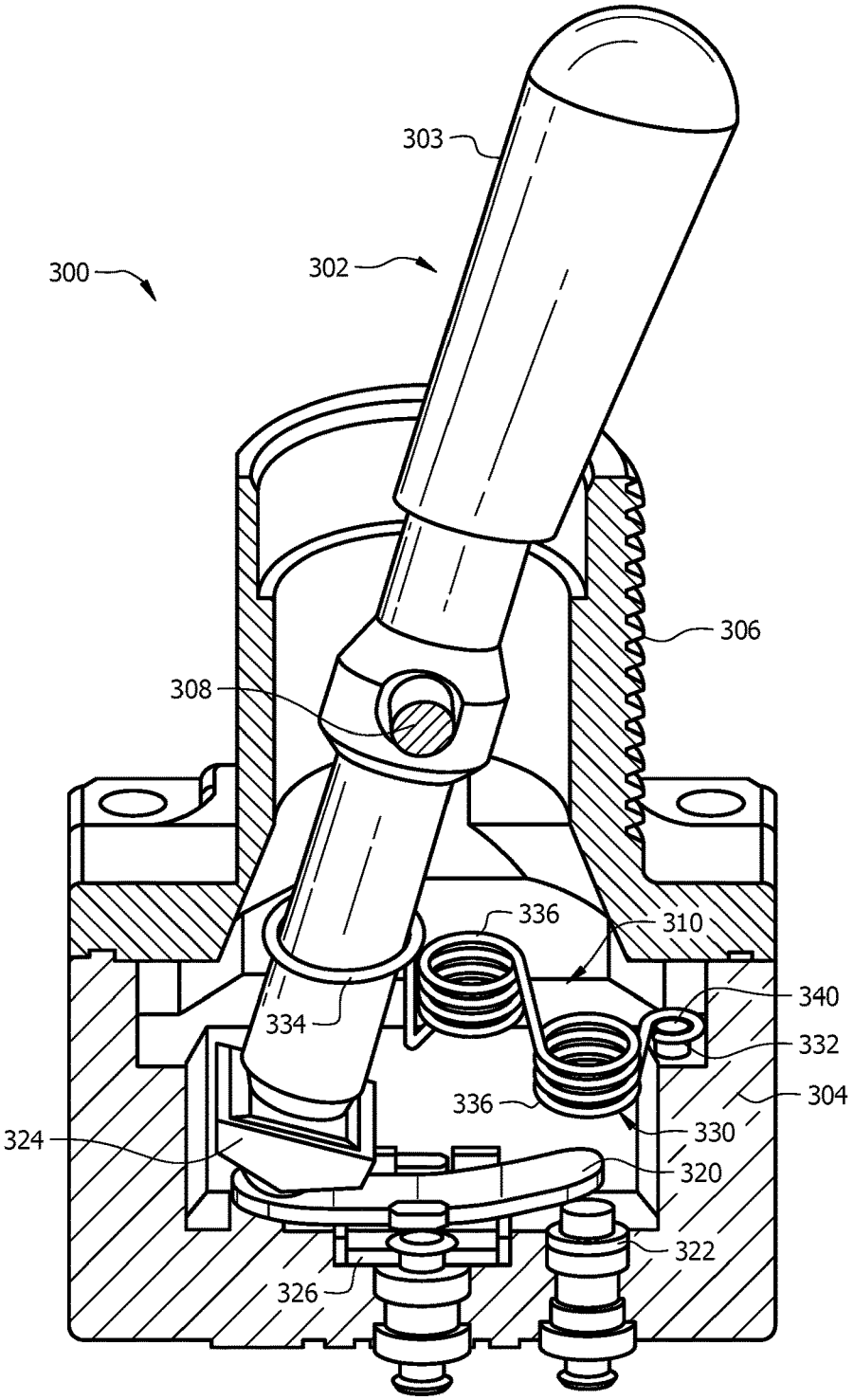
FIGS. 3A-3B illustrate cross-sectional views of a toggle switch comprising a bias mechanism according to an embodiment of the disclosure.
Figure 3B:
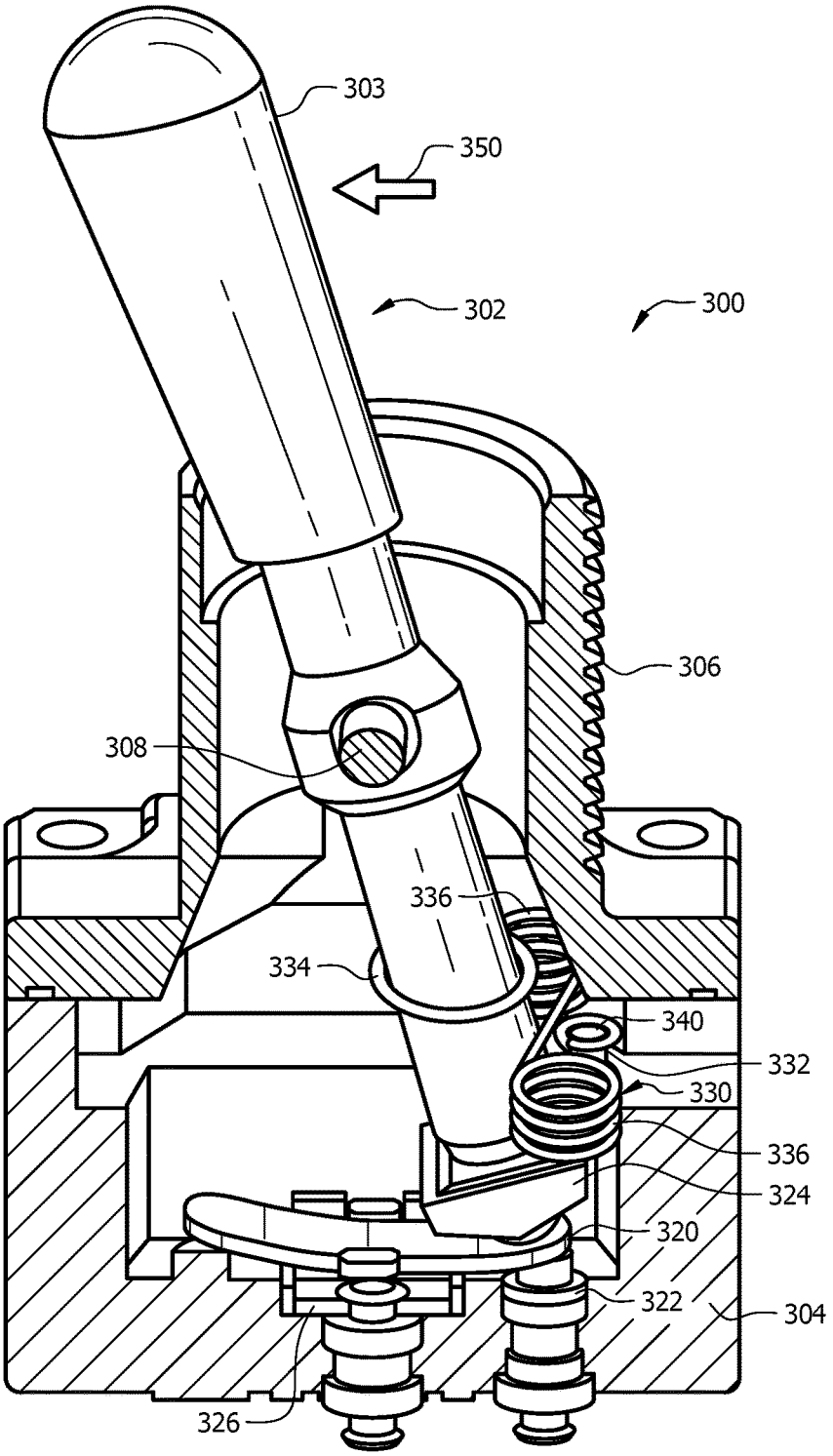

Referring now to FIGS. 3A and 3B, embodiments of the current disclosure include a toggle switch 300 comprising a single element bias mechanism 310. The single element bias mechanism 310 may comprise a torque spring 330. The torque spring 330 may also be known as a "torsion spring" comprising one or more coils configured to provide a bias in a particular direction. The toggle switch 300 may be similar to the toggle switch 100 described above. The toggle switch 300 may comprise a toggle mechanism 302 having an actuating lever 303 extending into a housing 304. The actuating lever 303 may extend from an exterior of the housing 304 into an interior of the housing 304 through a cap 306. The cap 306 can be affixed and/or sealed to the housing 304. A pivot pin 308 can be coupled to the cap 306 and extend through the actuating lever 303 to serve as a pivot point for the actuating lever 303 and control the movement of the actuating lever 303 about the axis of the pivot pin 308.

The toggle switch 300 may comprise a momentary toggle switch, wherein the toggle mechanism 302 may be biased in an "open" position unless a force acts on the switch to momentarily move the toggle mechanism 302 to a "closed" position, activating an electrical connection between the contacts. When no force is active on the actuating lever 303 outside of the cap 306, another force within the housing may bias the actuating lever 303 into an open position. This force may be provided by the bias mechanism 310.

An actuator assembly 324 can be coupled to an end of the actuating lever 303 within the housing 304 to allow actuation of a movable contact 320. One or more electrical connections 322 and 326 (which may be contacts, retainers, or other conductive elements) can be electrically coupled to the movable contact 320, which can selectively contact the fixed contact 322 to provide a signal to one or more external devices such as controllers. In some embodiments, the movable contact 320 may comprise a curved element attached to an axis 326, wherein the actuator assembly 324 may move along the movable contact 320 and rotate the movable contact 320 about the axis 326. In some embodiments, the axis 326 may also comprise a contact and/or an electrically conductive retainer to electrically couple the contact with the moveable contact 320.

In FIG. 3A, the toggle switch 300 may be in an "open" position, where the movable contact 320 is not in contact with the fixed contact 322, and therefore there is no electrical connection between the movable contact 320 and the fixed contact 322. In FIG. 3B, the toggle switch 300 may be in a "closed" position, wherein the movable contact 320 is contacting the fixed contact 322, and therefore an electrical current is communicated through the contacts 320 and 322, and a function may be activated by the toggle switch 300.

The actuating lever 303 can extend from an exterior of the housing 304 into an interior of the housing 304 through a cap 306. A pivot pin 308 can be coupled to the cap 306 and extend through the actuating lever 303 to serve as a pivot point for the actuating lever 303 and control the movement of the actuating lever 303 about the axis of the pivot pin 308. For example, the actuating lever 303 can be constrained to move in a direction normal to the longitudinal axis of the pivot pin 308 in a rotational manner.

The bias mechanism 310 for the toggle mechanism 302 may comprise a single torque spring 330. In some embodiments, the bias mechanism 310 may not comprise any other elements than the torque spring 330. The torque spring 330 may comprise a fixed end 332 and a movable end 334. The fixed end 332 may be attached to portion 340 of the housing 304. The portion 340 may comprise a protrusion or rod, where the fixed end 332 may fit around the portion 340 of the housing 304. The movable end 334 of the torque spring 330 may be configured to fit around at least a portion of the actuating lever 303.

The torque spring 330 may comprise one or more coils 336 located between the fixed end 332 and the movable end 334. In the embodiment shown in FIGS. 3A-3B, two coils 336 may be used, wherein the coils 336 may be positioned on either side of the actuating lever 303. As shown in FIG. 3B, when a force (indicated by arrow 350) pushes the actuating lever 303 toward the fixed end 332 of the torque spring 330, the coils 336 may compress and allow the actuating lever 303 to be pushed between the coils 336. The torque spring 330 may allow the actuating lever 303 to move closer to the housing 304 than typical bias mechanisms (such as the biasing mechanism 110 described above), and this may allow the size of the housing 304 to be decreased while maintaining the same travel distance for the actuating lever 303.

The bias mechanism 310 shown in FIGS. 3A-3B reduces the mechanism to only one element, the torque spring 330. Reducing the complexity and number of elements required for biasing the actuating lever 303 allows for a simpler device that is easier to manufacture. Additionally, the cost of the device may be decreased, and the opportunity of part failures may be reduced.

Figure 4:
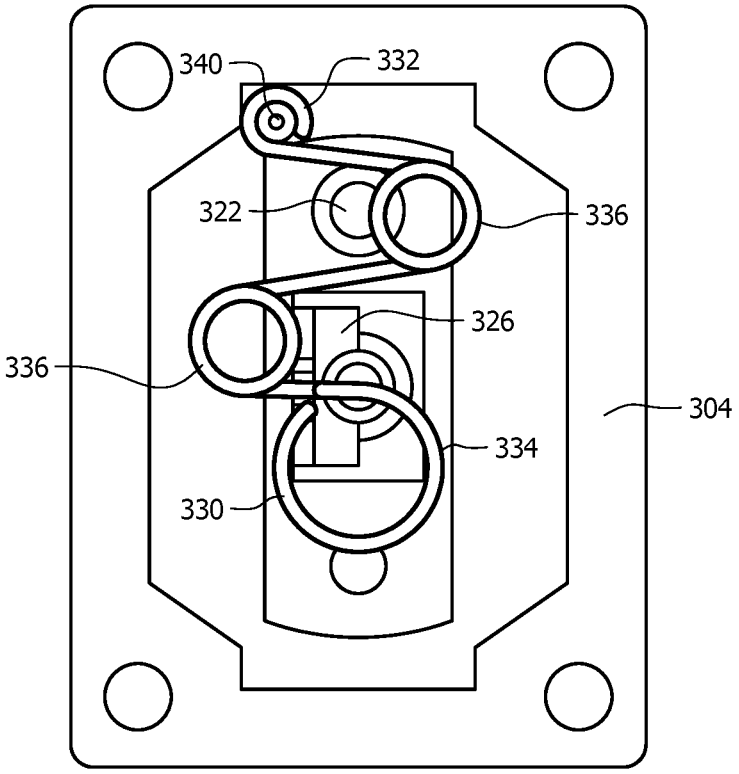
FIG. 4 illustrates a top view of a toggle switch comprising a bias mechanism according to an embodiment of the disclosure.

FIG. 4 illustrates a top view of the housing 304 with the cap 306 removed. The spring 330 may be attached to the housing 304 via a protrusion or rod 340 extending from the housing 304. The fixed end 332 of the torque spring 330 may comprise a ring configured to fit around the protrusion 340. The movable end 334 of the torque spring 330 may comprise a ring configured to fit around the actuating lever 303 (shown above).

The moveable contact 320 and the fixed contact 322, when contacting one another, may provide an electrical signal within the housing 304, and/or an external device, such as control circuitry or the like. The electrically conductive elements 320, 322 and 326 can be sealed using a potting material or other sealed connection through the housing 304.

Referring to FIGS. 3-4, the bias mechanism 310 may maintain the actuating lever 303 in the open position within the housing 304. A force can be applied to the outer portion of the actuating lever that is greater than the bias force provided by the bias mechanism 310. In response to this force, the interior end of the actuating lever 303 can begin to move the actuator assembly 324 along the moveable contact 320. As the actuating lever 303 moves past the pivot point adjacent the first contact, the moveable contact 320 may begin to rotate in response to the force provided by the actuator assembly 324. As the actuating lever 303 continues to move into the actuated position, the actuator assembly 324 can push the moveable contact 320 into contact with the second contact. In this position, an electrical connection or pathway is established between the two contacts either directly through the moveable contact 320 or through the connector forming a portion of the pivot above the first contact and through the moveable contact 320. As the actuating lever 303 moves into the closed position, the bias mechanism 310 can compress and the plurality of coils can align on either side of the actuating lever 303. In this arrangement, at least one coil of the plurality of coils can be disposed on either side of the actuating lever 303 within the housing 304.

In order to remain in the closed position, the force on the outer portion of the actuating lever 303 must be retained. When the force is removed, the bias force from the bias mechanism 310 can be sufficient to move the actuating lever 303 from the closed position back to the open position.

Having described various devices and methods, various embodiments can include, but are not limited to:

In a first embodiment, a toggle switch may comprise a housing; a plurality of contacts disposed within the housing; an actuating lever coupled to a pivot pin, wherein the actuating lever extends into the housing; an actuator assembly coupled to the actuating lever, configured to actuate a movable contact of the plurality of contacts between a first position and a second position; and a biasing mechanism configured to bias the actuator assembly into the first position, wherein the biasing mechanism comprises a torque spring.

A second embodiment can include the toggle switch of the first embodiment, wherein the movable contact contacts a fixed contact when the movable contact is actuated into the second position, thereby creating an electrical connection between the movable contact and the fixed contact.

A third embodiment can include the toggle switch of the second embodiment, wherein the electrical connection between the movable contact and the fixed contact provides a signal to an external device.

A fourth embodiment can include the toggle switch of any of the first to third embodiments, wherein the biasing mechanism comprises a single torque spring affixed to the housing and configured to engage with the actuating lever.

A fifth embodiment can include the toggle switch of any of the first to fourth embodiments, wherein the torque spring comprise a fixed end configured to attach to a portion of the housing and a movable end configured to attach to the actuating lever, wherein the movable end moves with respect to the fixed end.

A sixth embodiment can include the toggle switch of the fifth embodiment, wherein the torque spring comprises at least one coil located between the fixed end and the movable end.

A seventh embodiment can include the toggle switch of the fifth or sixth embodiments, wherein the torque spring comprises two coils located between the fixed end and the movable end, and wherein, when the torque spring is compressed, the two coils are located on either side of the actuating lever.

An eighth embodiment can include the toggle switch of any of the fifth to seventh embodiments, wherein the torque spring comprises at least one vertical coil located between the fixed end and the movable end, wherein the direction of the vertical coil is approximately perpendicular to the direction of movement of the actuating lever.

A ninth embodiment can include the toggle switch of any of the first to eighth embodiments, further comprising a cap coupled to the housing, wherein the actuating lever extends through the cap into the housing, and wherein the pivot pin is coupled to the cap.

A tenth embodiment can include the toggle switch of any of the first to ninth embodiments, wherein the toggle switch comprises a momentary switch.

An eleventh embodiment can include the toggle switch of any of the first to tenth embodiments, wherein the movable contact comprises a curved element attached to an axis, and wherein the actuator assembly is configured to rotate the movable contact about the axis.

In a twelfth embodiment, a method of operating a toggle switch may comprise providing an actuation force to an actuating lever while the actuating lever is in a first position; moving an actuator assembly located at the end of the actuating lever from the first position toward a second position in response to the actuation force; compressing a torque spring disposed about the actuating lever in response to the moving; and actuating an electrical connection between a movable contact and a fixed contact in response to the moving.

A thirteenth embodiment can include the method of the twelfth embodiment, further comprising releasing the actuation force from the actuating lever; moving the actuator assembly from the second position toward the first position in response to the bias from the compressed spring; and de-actuating the electrical connection between the movable contact and the fixed contact.

A fourteenth embodiment can include the method of any of the twelfth to thirteenth embodiments, wherein moving the actuator assembly from the first position toward the second position comprises moving the actuator assembly from one end of a movable contact toward the other end of the movable contact.

A fifteenth embodiment can include the method of the any of the twelfth to fourteenth embodiments, wherein the torque spring is directly affixed to the actuating lever.

A sixteenth embodiment can include the method of any of the twelfth to fifteenth embodiments, wherein the torque spring is directly affixed to a housing of the toggle switch.

In a seventeenth embodiment, a toggle switch may comprise a housing; a fixed contact disposed within the housing; a movable contact disposed within the housing, wherein the movable contact is configured to move between a first position and a second position; an actuating lever coupled to a pivot pin, wherein the actuating lever extends into the housing; an actuator assembly coupled to the actuating lever, configured to actuate the movable contact between the first position and the second position; and a biasing mechanism configured to bias the actuator assembly into the first position, wherein the biasing mechanism comprises a torque spring configured to attach to the housing and the actuating lever.

An eighteenth embodiment can include the toggle switch of the seventeenth embodiment, wherein the movable contact is configured to contact the fixed contact when the movable contact is in the second position.

A nineteenth embodiment can include the toggle switch of the seventeenth or eighteenth embodiments, wherein the movable contact comprises a curved element attached to an axis, and wherein the actuator assembly is configured to rotate the movable contact about the axis.

A twentieth embodiment can include the toggle switch of any of the seventeenth to nineteenth embodiments, wherein the torque spring comprises a fixed end configured to attach to a portion of the housing; a movable end configured to attach to the actuating lever, wherein the movable end moves with respect to the fixed end; and at least one vertical coil located between the fixed end and the movable end, wherein the direction of the vertical coil is approximately perpendicular to the direction of movement of the actuating lever.

A twenty-first embodiment can include the toggle switch of any of the first to twentieth embodiments, wherein the biasing mechanism does not comprise any elements other than the torque spring.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A toggle switch comprising:

a housing;

a plurality of contacts disposed within the housing;

an actuating lever coupled to a pivot pin, wherein the actuating lever extends into the housing;

an actuator assembly coupled to the actuating lever, configured to actuate a movable contact of the plurality of contacts between a first position and a second position; and a biasing mechanism configured to bias the actuator assembly into the first position, wherein the biasing mechanism comprises a torque spring, wherein a first coil of the torque spring is disposed on a right side of a vertical plane that bisects the actuating lever and a second coil of the torque spring is disposed on a left side of the vertical plane that bisects the actuating lever.

2. The toggle switch of claim 1, wherein the biasing mechanism comprises a single torque spring affixed to the housing and configured to engage with the actuating lever.

3. The toggle switch of claim 1, further comprising a cap coupled to the housing, wherein the actuating lever extends through the cap into the housing, and wherein the pivot pin is coupled to the cap.

4. The toggle switch of claim 1, wherein the toggle switch comprises a momentary switch; wherein the torque spring comprises a ring that is configured to fit around a protrusion extending from the housing.

5. The toggle switch of claim 1, wherein the movable contact comprises a curved element attached to an axis, and wherein the actuator assembly is configured to rotate the movable contact about the axis.

6. The toggle switch of claim 1, wherein the movable contact is electrically coupled to a first contact, wherein the movable contact is in contact with a fixed contact when the movable contact is in the second position, and wherein an electrical connection is formed between the first contact, the movable contact, and the fixed contact in the second position.

7. The toggle switch of claim 6, wherein the electrical connection between the movable contact and the fixed contact provides an electrical connection to an external device.

8. The toggle switch of claim 1, wherein the torque spring comprises a fixed end configured to attach to a portion of the housing and a movable end configured to attach to the actuating lever, wherein the movable end moves with respect to the fixed end.

9. The toggle switch of claim 8, wherein the torque spring comprises at least one coil located between the fixed end and the movable end.

10. The toggle switch of claim 8, wherein the torque spring comprises two coils located between the fixed end and the movable end, and wherein, when the torque spring is compressed, the two coils are located on either side of the actuating lever.

11. The toggle switch of claim 8, wherein the torque spring comprises at least one vertical coil located between the fixed end and the movable end, wherein the direction of the vertical coil is approximately perpendicular to the direction of movement of the actuating lever.

12. A method of operating a toggle switch, the method comprising:

providing an actuation force to an actuating lever while the actuating lever is in a first position;

moving an actuator assembly located at an end of the actuating lever from the first position toward a second position in response to the actuation force;

compressing a torque spring disposed about the actuating lever in response to the moving;

and actuating an electrical connection between a movable contact and a fixed contact in response to the moving, wherein a first coil of the torque spring is disposed on a right side of a vertical plane that bisects the actuating lever and a second coil of the torque spring is disposed on a left side of the vertical plane that bisects the actuating lever.

13. The method of claim 12, further comprising:

releasing the actuation force from the actuating lever;

moving the actuator assembly from the second position toward the first position in response to the bias from the compressed torque spring; and de-actuating the electrical connection between the movable contact and the fixed contact.

14. The method of claim 12, wherein moving the actuator assembly from the first position toward the second position comprises moving the actuator assembly from one end of a movable contact toward another end of the movable contact.

15. The method of claim 12, wherein the torque spring is directly affixed to the actuating lever.

16. The method of claim 12, wherein the torque spring is directly affixed to a housing of the toggle switch.

17. A toggle switch comprising:

a housing;

a fixed contact disposed within the housing;

a movable contact disposed within the housing, wherein the movable contact is configured to move between a first position and a second position;

an actuating lever coupled to a pivot pin, wherein the actuating lever extends into the housing;

an actuator assembly coupled to the actuating lever, configured to actuate the movable contact between the first position and the second position; and a biasing mechanism configured to bias the actuator assembly into the first position, wherein the biasing mechanism comprises a torque spring configured to attach to the housing and the actuating lever, wherein a first coil of the torque spring is disposed on a right side of a vertical plane that bisects the actuating lever and a second coil of the torque spring is disposed on a left side of the vertical plane that bisects the actuating lever.

18. The toggle switch of claim 17, wherein the movable contact is configured to contact the fixed contact when the movable contact is in the second position.

19. The toggle switch of claim 17, wherein the movable contact comprises a curved element attached to an axis, and wherein the actuator assembly is configured to rotate the movable contact about the axis.

20. The toggle switch of claim 17, wherein the torque spring comprises: a fixed end configured to attach to a portion of the housing; a movable end configured to attach to the actuating lever, wherein the movable end moves with respect to the fixed end; and at least one vertical coil located between the fixed end and the movable end, wherein a direction of the vertical coil is substantially perpendicular to the direction of movement of the actuating lever.

* * * * *